US005634552A

United States Patent [19]

Soberski

[11] Patent Number: 5,634,552

[45] Date of Patent: Jun. 3, 1997

[54] TERMINAL/BLADE CONTACT ASSEMBLY

[75] Inventor: George A. Soberski, Des Plaines, Ill.

[73] Assignee: Eaton Corporation, Cleveland, Ohio

[21] Appl. No.: 489,202

[22] Filed: Jun. 9, 1995

[51] Int. Cl.[6] ..... H01H 1/00

[52] U.S. Cl. ..... 200/284; 200/275; 29/622

[58] Field of Search ..... 200/244, 245, 200/246, 238, 239, 247, 275, 271, 282, 284; 29/622

[56] References Cited

U.S. PATENT DOCUMENTS

| | | | |
|---|---|---|---|
| 2,616,011 | 10/1952 | Elliott | 200/244 |
| 2,976,384 | 3/1961 | McLauchlin | 200/284 |
| 3,118,998 | 1/1964 | Mastney | 200/284 |
| 3,175,066 | 3/1965 | Fiddler | 200/284 |
| 3,209,110 | 9/1965 | Meyer | 200/284 |
| 3,344,250 | 9/1967 | Duval | 29/622 |

*Primary Examiner*—David J. Walczak
*Attorney, Agent, or Firm*—Roger A. Johnston

[57] ABSTRACT

A combined connector terminal blade contact is formed by stamping a flat blank from sheet stock and following an end portion to form a double thickness connector terminal which is sufficiently rigid to provide for mounting through a slot in a housing; and, the terminal portion is intended to extend through the housing for external electrical connection thereto. An electrical contact is welded to the blade portion for forming one side of a switch.

4 Claims, 3 Drawing Sheets

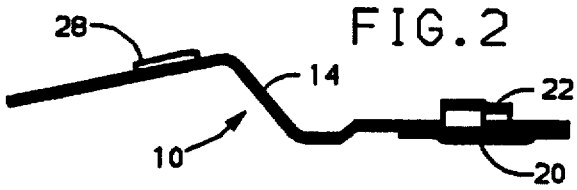
FIG. 2
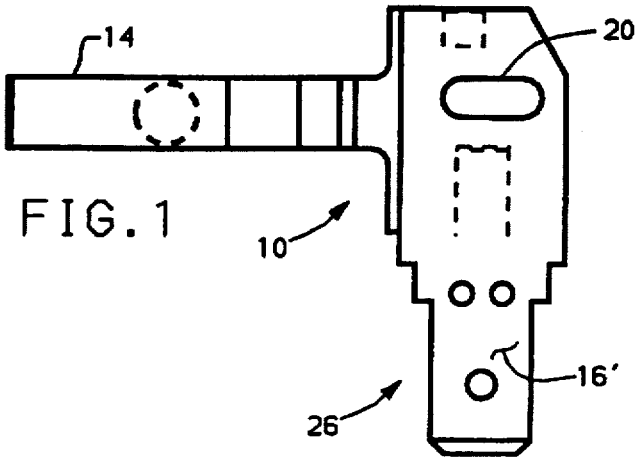
FIG. 1
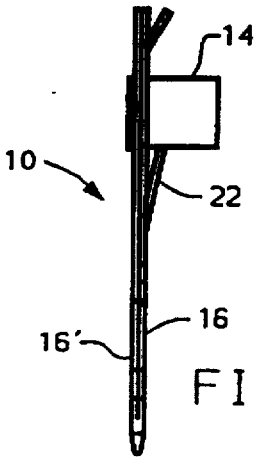
FIG. 3
FIG. 6
PRIOR ART
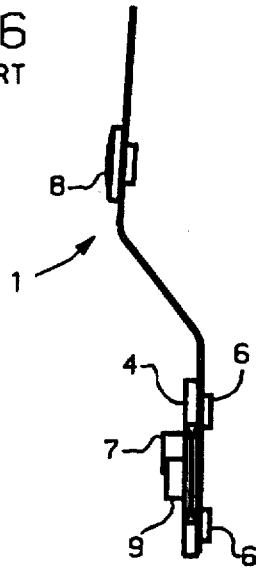
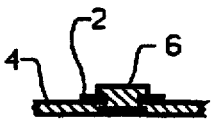
FIG. 7
PRIOR ART
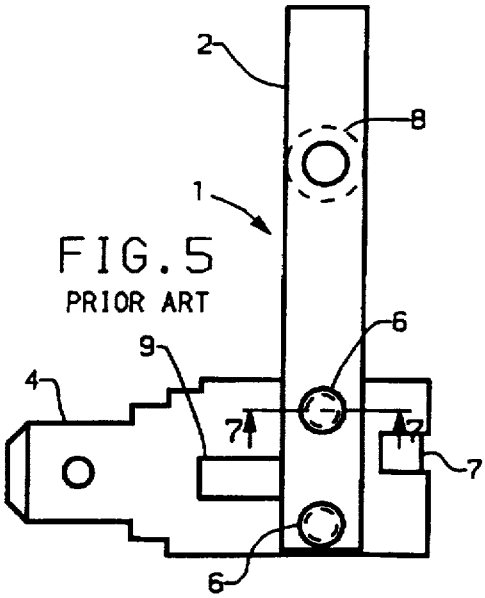
FIG. 5
PRIOR ART

TERMINAL/BLADE CONTACT ASSEMBLY

BACKGROUND OF THE INVENTION

The present invention relates to contact blades for switch assemblies of the type where the contact blade is combined with an electrical connector terminal and is mounted on the switch casing or housing with portions of the terminal extending through the housing and adapted for external electrical connection thereto. Combination terminal and switch blades are typically employed in programmer switch assemblies of the type having a rotary cam acting against one of the switch blades for effecting movement of the blade and opening and closing a set of electrical contacts for making and breaking an electrical circuit. This type of terminal/blade contact arrangement is particularly suitable for the manufacture of programmer timers where the cam is advanced by a timing mechanism such as a motor driven ratchet and pawl type advance.

Programmer timers of this description are often employed in the control of program sequences for appliances.

Heretofore, cam operated switches and particularly switches of the type employed for appliance programmers have utilized separate pieces riveted together to form a flat switch blade capable of resilient deflection or movement by a cam with a thickened base portion for forming the terminal which is to be inserted through an aperture in the switch housing in a manner retaining the switch blade in a fixed location and position on the housing. The connecting terminal portion of the assembly extends through the housing for external attachment. Such two-piece blade and terminal constructions have proven to be quite costly in high volume mass production and have required costly tooling, fixtures and machinery to automatically position and rivet the terminal portion to the blade. Accordingly, it has been desired to provide an improved reduced cost terminal/blade contact arrangement for assembly onto a switch housing.

Heretofore, as shown in FIGS. 5 and 6 the aforesaid type insertable terminal/blade contact assemblies as indicated generally at 1 in FIGS. 5 and 6 were fabricated by forming a separate contact blade 2 and terminal member 4 from flat stock of differing thickness, with the terminal 4 generally formed of material of several multiples of the thickness of the blade 2. The terminal 4 was typically attached to the blade 2 in a generally right angle arrangement by a pair of fasteners such as rivets 6. A switching contact 8 was attached also typically by riveting to the contact blade 2. Typically, the terminal member 4 was provided with stamped tabs or barbs denoted by reference numerals 7, 9 to prevent removal of the terminal upon insertion into the switch housing.

SUMMARY OF THE INVENTION

It is an object of the present invention to provide an improved combination connector terminal/blade contact assembly for use in a controller or switching device such as a programmer timer and to have a unitary switch blade contact and connector terminal insertable into a housing for providing a switch blade arm and a connector terminal which extends from the housing and is adapted for external electrical connection.

It is a further object of the present invention to provide a combination switch blade contact and connector terminal formed unitarily from a sheet stock blank and folded to provide a double thickness for the connector terminal portion.

The connector terminal/blade contact assembly of the present invention is formed by stamping a blank from flat sheet stock and folding the blank about a line which forms the end of the connector terminal to provide a double thickness of material for the terminal portion which is insertable into a housing and subsequently attaching an electrical contact to the blade portion for forming a switch blade arm. The double thickness terminal portion extends generally at right angles to the switch blade arm to facilitate insertion and assembly of the terminal portion through an aperture or slot in a housing with the terminal adapted to extend externally of such a housing.

The present invention thus provides a combination connector terminal and switch blade arm formed from a single sheet stock blank and having the terminal portion comprising a double thickness of material to facilitate mounting and with the blade arm formed of a single thickness of material to permit resilient deflection of the blade arm for functioning as a moveable switch member.

BRIEF DESCRIPTION OF THE DRAWINGS

FIG. 1 is a plane view of the terminal/blade contact assembly of the present invention;

FIG. 2 is a top view of the assembly of FIG. 1;

FIG. 3 is a right-hand elevation view of the assembly of FIG. 1;

FIG. 5 is a plan view of an assembly of the prior art;

FIG. 6 is a left-hand elevation view of the prior art assembly of FIG. 5;

FIG. 7 is a portion of a section view taken along section indicating liens 7—7 of the prior art device of FIG. 5; and, FIG. 8 is an exploded view of the terminal/blade contact assembly of the present invention as installed in a switching device housing.

DETAILED DESCRIPTION

Figure 4:
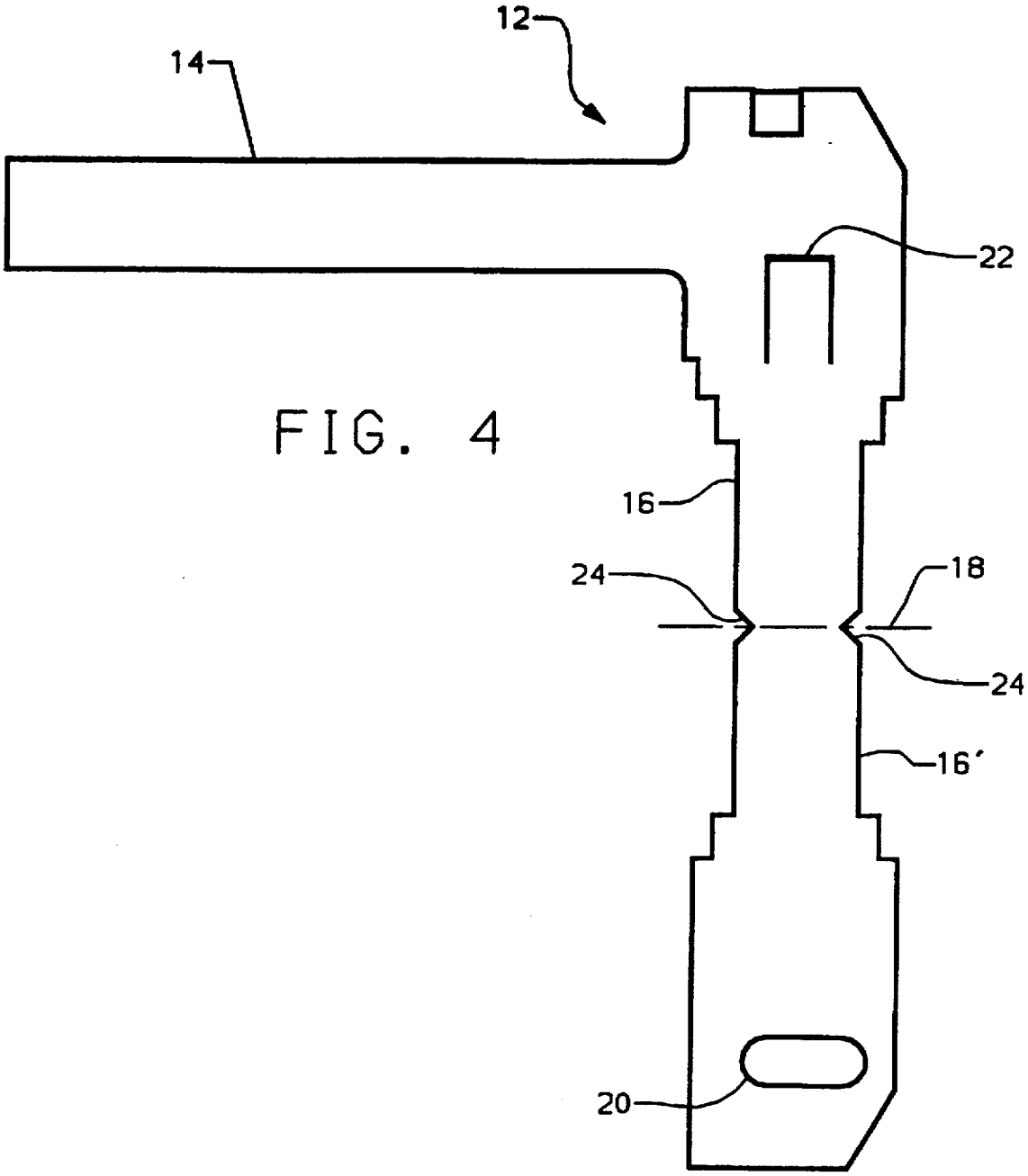
FIG. 4 is a plan view of the flat blank for forming the assembly of FIG. 1.

Referring to FIGS. 1 through 4, the terminal/blade contact assembly of the present invention is indicated generally at 10 and is formed preferably by stamping from a flat blank indicated generally at 12 formed from a single piece of sheet stock and has a blade portion 14 extending generally at right angles to a terminal portion 16 and an oppositely disposed symmetrically-shaped terminal portion 16' formed about a line of symmetry 18 as shown in FIG. 4.

The blank 12 has stamped therein adjacent the remote end of the terminal portion 16' a dimple 20 which serves as a limit stop for insertion of the terminal into a housing. The terminal portion 16 has at least one tabbed or barbed portion 22 formed therein for preventing withdrawal of the terminal when installed. The terminal portions 16, 16' have a pair of oppositely disposed V-notches 24 formed therein on opposite sides thereof and located along the line of symmetry 18 such that upon folding of the blank about the line of symmetry the notches become chamfers on the end of the double thickness terminal comprising portions 16, 16'.

Referring to FIGS. 1 through 3, the terminal/blade contact is shown in a condition after folding of the portion 16' back upon the portion 16 about line of symmetry 18 to form a double thickness terminal portion indicated generally at 26 which, as shown in FIG. 3, comprises a portion 16 and a portion 16'. The double-thickness terminal portion 26 is thus sufficiently rigid to support the assembly when mounted by insertion of the portion 26 in a slot. The blade contact 14 has been formed in the illustrated embodiment to an offset or somewhat sinusoidal configuration as shown in FIG. 2; and, an electrical contact 28 has been attached to one side of the blade 14 preferably by weldment. The configuration of the blade 14 has been chosen to accommodate movement thereof by a suitable cam mechanism (not shown).

Figure 8:
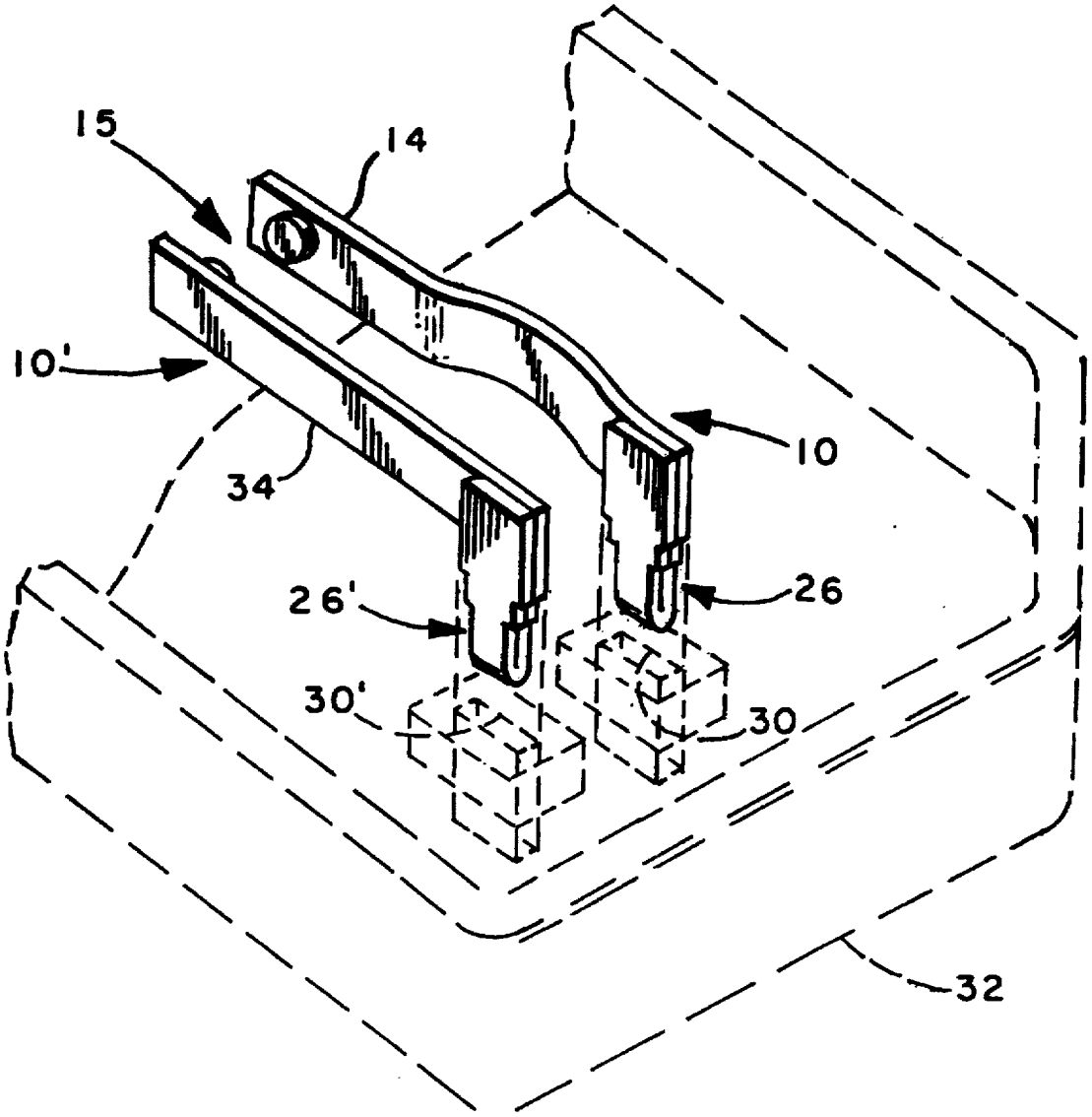

Referring to FIG. 8, the assembly 10 is shown as in position for insertion into a slot 30 formed in a switch housing 32 shown in dashed outline. A second or alternate version of the assembly is shown at 10' having a straight contact blade 34 which serves to provide the other side of a switch indicated generally at 15 comprising the contact blades 14, 34; and, the assembly 10' has a terminal portion 26' insertable into a slot 30' in housing 32. It will be understood that the terminal portion 26, 26', when inserted into the slots 30, 30' extend outwardly to the exterior of the housing 32 and are adapted for external electrical connection thereto.

The present invention thus provides a unique construction for a combination connector terminal/contact blade formed from a flat blank and folded to form a double thickness for the connector terminal portion which extends at a right angle to the blade contact to permit the terminal to be inserted into a housing from the interior thereof for mounting and to extend outwardly the housing and adapted for external electrical connection thereto. The construction of the present invention provides a reliable terminal/blade contact assembly which is economical to manufacture in high volume production and minimizes the number of parts required to provide a complete switch blade contact assembly with an integrally formed connecting terminal.

Although the invention has been described hereinabove with respect to the particular embodiment illustrated, it will be understood that those having ordinary skill in the art that the invention is capable of modification and variation and is more particularly described by the following claims.

We claim:

1. A method of making a combination switch blade contact/connector terminal of the type mountable by inserting the connector terminal in a slot comprising:

(a) laying out a pattern of an elongated blade portion and a terminal portion extending from said blade at a fight angle and forming a flat blank to said pattern from a relatively thin sheet metal;

(b) folding said terminal portion of said blanks on itself and doubling the thickness of said terminal portion of said blank and leaving said elongated blade portion of a single thickness of said sheet metal; and (c) attaching an electrical contact to said elongated blade remote from said doubled thickness.

2. The method defined in claim 1 wherein said step of folding said terminal portion includes forming an end of said terminal portion with said fold.

3. In a combination switch blade contact/connector terminal assembly of the type having the connector terminal inserted in a slot, the improvement comprising:

(a) an elongated resilient blade portion formed of electrically conductive sheet material having a thickness relatively small with respect to its width;

(b) an electrical contact attached to said blade adjacent an end thereof, said blade adapted for resilient deflection; and (c) an insertable terminal portion formed of said sheet material integrally with said blade portion and extending at a generally right angle from said blade portion at an end remote from said contact, wherein said insertable terminal portion is integrally formed to a double thickness by folding said sheet metal.

4. The assembly defined in claim 3, wherein said terminal portion is folded at an end insertable in the slot.

* * * * *

UNITED STATES PATENT AND TRADEMARK OFFICE

CERTIFICATE OF CORRECTION

PATENT NO. : 5,634,552

DATED : June 3, 1997

INVENTOR(S) : George A. Soberski

It is certified that error appears in the above-indentified patent and that said Letters Patent is hereby corrected as shown below:

COLUMN 4, LINE 9 -- "blanks" should read -- blanks --

Signed and Sealed this

Ninth Day of September, 1997

*Attest:*

BRUCE LEHMAN

*Attesting Officer*

*Commissioner of Patents and Trademarks*